US011359384B2

(12) United States Patent
Markovski et al.

(10) Patent No.: US 11,359,384 B2
(45) Date of Patent: Jun. 14, 2022

(54) JOINING SYSTEM FOR FLOOR PANELS

(71) Applicant: VILOX AB, Helsingborg (SE)

(72) Inventors: Bobby Markovski, Helsingborg (SE); Bengt Rosander; Magnus Persson, Helsingborg (SE)

(73) Assignee: Vilox AB, Helsingborg (SE)

( * ) Notice: Subject to any disclaimer, the term of this patent is extended or adjusted under 35 U.S.C. 154(b) by 0 days.

(21) Appl. No.: 16/965,063

(22) PCT Filed: Jan. 28, 2019

(86) PCT No.: PCT/EP2019/051939

§ 371 (c)(1),
(2) Date: Jul. 27, 2020

(87) PCT Pub. No.: WO2019/145521

PCT Pub. Date: Aug. 1, 2019

(65) Prior Publication Data

US 2021/0062517 A1 Mar. 4, 2021

(30) Foreign Application Priority Data

Jan. 27, 2018 (SE) ..... 1830029-3

(51) Int. Cl.
*E04F 15/02* (2006.01)
*E04F 15/10* (2006.01)

(52) U.S. Cl.
CPC ..... *E04F 15/02038* (2013.01); *E04F 15/10* (2013.01); *E04F 2201/0146* (2013.01); *E04F 2201/023* (2013.01); *E04F 2201/0535* (2013.01)

(58) Field of Classification Search
CPC ..... E04F 15/02038; E04F 15/10; E04F 2201/0146; E04F 2201/023; E04F 2201/0535; E04F 2201/0138
(Continued)

(56) References Cited

U.S. PATENT DOCUMENTS 3,740,914 A * 6/1973 Arnaiz Diez ..... E04F 13/18 52/515
5,630,304 A * 5/1997 Austin ..... E04F 15/10 428/57

(Continued)

FOREIGN PATENT DOCUMENTS

CN 103547749 A 1/2014
CN 107075858 A 8/2017
WO WO 2014/033628 A1 3/2014

OTHER PUBLICATIONS

International Search Report and Written Opinion dated May 28, 2019 in corresponding International Application No. PCT/EP2019/051939.

(Continued)

*Primary Examiner* — Brent W Herring
(74) *Attorney, Agent, or Firm* — Seth Natter; Haug Partners LLP

(57) ABSTRACT

The invention relates to a joining system for floor panels, comprising a female coupling recess formed in a first floor panel, said female coupling recess being adapted to receive a male coupling tongue projecting from an adjoining second floor panel in a direction perpendicular to a main floor surface plane in which the floor panels are laid. The joining system further includes an elasticity slot for facilitating resilient movement in said vertical snap joint interlocking engagement.

18 Claims, 6 Drawing Sheets

(58) Field of Classification Search
USPC ..... 52/588.1, 589.1, 578
See application file for complete search history.

(56) References Cited

U.S. PATENT DOCUMENTS

| | | | | |
|---|---|---|---|---|
| 5,797,237 | A * | 8/1998 | Finkell, Jr. | E04F 15/04 52/586.1 |
| 6,647,690 | B1 * | 11/2003 | Martensson | E04F 15/02005 52/601 |
| 7,603,826 | B1 * | 10/2009 | Moebus | E04F 15/04 52/592.1 |
| 7,980,043 | B2 * | 7/2011 | Moebus | E04F 15/04 52/588.1 |
| 8,099,924 | B2 * | 1/2012 | Braun | E04G 23/006 52/390 |
| 8,191,333 | B2 * | 6/2012 | Braun | E04G 23/006 52/390 |
| 8,544,233 | B2 * | 10/2013 | Palsson | E04F 15/02038 52/588.1 |
| 8,991,055 | B2 * | 3/2015 | Cappelle | E04F 15/107 29/897.32 |
| 9,145,691 | B2 * | 9/2015 | Cappelle | E04F 15/02033 |
| 9,803,374 | B2 * | 10/2017 | Pervan | E04F 15/02038 |
| 10,161,139 | B2 * | 12/2018 | Pervan | E04C 2/40 |
| 10,287,777 | B2 * | 5/2019 | Boo | E04F 15/105 |
| 10,570,625 | B2 * | 2/2020 | Pervan | E04F 15/02038 |
| 10,808,410 | B2 * | 10/2020 | Boo | E04F 15/105 |
| 10,851,549 | B2 * | 12/2020 | Boo | E04F 15/02038 |
| 2003/0145549 | A1 * | 8/2003 | Palsson | B44C 3/123 52/589.1 |
| 2006/0070332 | A1 * | 4/2006 | Palsson | E04F 15/04 52/586.1 |
| 2009/0249733 | A1 * | 10/2009 | Moebus | E04F 15/04 52/588.1 |
| 2010/0037550 | A1 * | 2/2010 | Braun | E04G 23/006 52/588.1 |
| 2012/0067461 | A1 * | 3/2012 | Braun | E04G 23/006 144/371 |
| 2015/0240500 | A1 | 8/2015 | Stevens, Jr. | |
| 2016/0201336 | A1 * | 7/2016 | Pervan | E04F 15/02038 52/582.2 |
| 2017/0284105 | A1 | 10/2017 | Ceysson et al. | |
| 2018/0030737 | A1 * | 2/2018 | Pervan | E04C 2/40 |
| 2019/0093371 | A1 * | 3/2019 | Pervan | E04F 15/102 |
| 2019/0211569 | A1 * | 7/2019 | Boo | E04F 15/105 |
| 2020/0102756 | A1 * | 4/2020 | Pervan | E04F 15/02038 |
| 2020/0149289 | A1 * | 5/2020 | Pervan | E04F 15/102 |

OTHER PUBLICATIONS

Office Action dated Jul. 3, 2020 in corresponding Chinese Application No. 201980002174.2.

* cited by examiner

JOINING SYSTEM FOR FLOOR PANELS

CROSS-REFERENCE TO RELATED APPLICATIONS

The present application is filed pursuant to 35 U.S.C. § 371 based on PCT International Application No. PCT/EP2019/051939, filed on Jan. 28, 2019, which claims priority from Swedish Patent Application No. 1830029-3, filed on Jan. 27, 2018, the disclosures of which are incorporated herein by reference in their entirety.

TECHNICAL FIELD

The invention relates to a joining system for floor panels, comprising a female coupling recess formed in a first floor panel wherein said female coupling recess is shaped for receiving a male coupling tongue projecting from an adjoining second floor panel in a direction perpendicular to a main floor surface plane in which the floor panels are laid. The male coupling tongue is provided with vertical locking means enabling a vertical snap joint interlocking engagement with a matching vertical locking means in the female coupling recess. Furthermore the joining system includes an elasticity slot for facilitating resilient movement in said vertical snap joint interlocking engagement.

BACKGROUND

A current trend in joining systems for prefabricated floor panels is to use one of many variants of angle-in tongue- and groove joints on the long sides of a typical rectangular floor panels and then use a so called fold-down joint for joining the remaining short sides of the floor panels. This combined use of angle-in joints and fold-down joints and fold-down joints makes it easier to and less time-consuming to lay a floor both for professionals and for DIY (Do-It-Yourself) customers compared with earlier angle-in/angle-in joining systems that required both the long and the short sides of the floor panels to be angled into connection.

A fold-down joining system typically includes some kind of vertical snap-lock action which allows the joint to easily snap in place as the floor panels are folded down into engagement along the short sides of the floor panels. Existing prior-art snap-lock designs for fold-down joints include various forms of vertical locking means, such as angled or rounded locking lugs intended to snap into engagement with corresponding locking recesses or vice versa. Some fold-down joints include separately inserted resilient plastic or rubber tongue elements for obtaining an efficient and positive locking between two adjoining floor panels. These joints generally function well, although they are also more complicated and thus more expensive to manufacture compared to joints without such separate inserts, rendering them unsuitable for large scale flooring production.

Prefabricated floor panels are manufactured globally in a vast variety of materials and structural designs, such as laminate flooring, wood flooring, LVT (Luxury Vinyl Tiles), PVC to name but a few. All these floor panels have very different material and manufacturing properties and it is far from certain that a particular fold-down joining system which works well in one type of floor panel will work equally well in another type of floor panel of different composition and material. For this reason it is highly desirable for floor manufacturers to find a fold-down joining system which allows for an effective snap-lock action in as many of the widely used floor panel types as possible. To this end, some prior art fold-down joining systems include the use of elasticity slots or grooves located in the vicinity of the vertical locking means. Such elasticity slots will improve the resilient properties of the joint, rendering it more suitable for a wider range of floor panel types in order to avoid undesired stress loads for more brittle materials or composite floor panel designs.

A problem with prior-art fold-down joints with elasticity slots is that the slots are positioned in such ways as to weaken the structural integrity of the joining system. An example of this is undesired externally visible slot openings that have to be filled with elastic filling compounds in order to avoid undesired ingress of moist or foreign objects during the floor-laying work.

Furthermore, in order to ascertain an effective vertical locking, many prior-art fold-down joining systems include more than one vertical locking function between the joining parts of adjoining floor panels. A problem with multiple vertical locking functions is that they inevitably make the joining parts more complicated to manufacture and hence also more expensive due to additional tooling costs.

Hence it is the object of the present invention to provide a system for joining floor panels in which the need for more than one vertical locking function is eliminated whilst offering an easily operable snap-locking action.

SUMMARY

The object described above is achieved by a joining system for floor panels, comprising a female coupling recess formed in a first floor panel wherein said female coupling recess is shaped for receiving a male coupling tongue projecting from an adjoining second floor panel in a direction perpendicular to a main floor surface plane in which the floor panels are laid. The male coupling tongue is provided with vertical locking means enabling a vertical snap joint interlocking engagement with a matching vertical locking means in the female coupling recess.

Furthermore the joining system includes an elasticity slot for facilitating resilient movement in said vertical snap joint interlocking engagement.

The male coupling tongue is configured to be essentially resilient whereas the female coupling recess is configured to be essentially rigid and non-resilient. The invention is especially characterized in that:

the elasticity slot is located in the second floor panel, the male coupling tongue forming a side wall surface of the elasticity slot on the opposite side of the male coupling tongue with respect to the side with said vertical locking means, enabling enhanced resilience upon insertion of the male coupling tongue into the female coupling recess;

an upper guiding surface is located on a side of the female coupling recess on the first panel, forming an essentially non-resilient vertical guide for the male coupling tongue upon insertion thereof, limiting movement of said male coupling tongue in a horizontal direction towards a remaining, main portion of the first floor panel;

a lower guiding surface is located on an upwardly extending horizontal locking lip formed at a distal end of the female coupling recess with respect to the remaining, main portion of the first floor panel, said lower guiding surface forcing the male coupling tongue to resiliently deflect whilst in engagement with said upper guiding surface upon further vertical insertion thereof in a curved J-shaped deflection movement towards said remaining, main portion of the first floor panel, until the vertical locking means of the male coupling tongue snaps together with the matching vertical locking means of the female coupling recess and, that said lower guiding surface at its lowest end transitions into an essentially vertically extending horizontal locking surface exerting a horizontal pressure on the male coupling tongue in a horizontal direction towards a remaining, main portion of the first floor panel, holding the vertical locking means in engagement with each other in a fitted state between the first floor panel and the second floor panel.

In a favourable embodiment of the invention, at least a part of an upper limitation wall of the elasticity slot is essentially horizontally aligned with the vertical locking means of the male coupling tongue.

In one embodiment, the width of the elasticity slot essentially corresponds to the width of the upwardly extending horizontal locking lip formed at a distal end of the female coupling recess.

In another embodiment, the width of the elasticity slot is essentially half of the width of the upwardly extending horizontal locking lip formed at a distal end of the female coupling recess.

In yet another alternative embodiment of the invention, the width of the elasticity slot is essentially a third of the width of the upwardly extending horizontal locking lip formed at a distal end of the female coupling recess.

In an alternative embodiment, the elasticity slot is at least partially inclined so as to form a partial undercut into the side wall of the male coupling tongue.

In a favourable embodiment of the invention, an upper limitation wall of the elasticity slot transitions into an essentially vertical side wall of the male coupling tongue via a curved transition portion thereof.

In one embodiment, a resilient waterproofing seal is positioned in the elasticity slot, said waterproofing seal being configured to seal between the elasticity seal and an upper sealing surface of the of the upwardly extending horizontal locking lip formed at a distal end of the female coupling recess.

In a favourable embodiment of the invention, the vertical locking means on the male coupling tongue is constituted by a continuously curved bulb-shaped protrusion extending from the male coupling tongue and that the vertical locking means in the female coupling recess is constituted by a matching concave locking groove.

In another embodiment, the vertical locking means in said female coupling recess is constituted by a continuously curved bulb-shaped protrusion extending from the female coupling recess and that the vertical locking means on the male coupling tongue is constituted by a matching concave locking groove.

In a well-functioning embodiment of the invention, the joining system includes a single set of mutually matching vertical locking means located on the male coupling tongue and in the female coupling recess, respectively.

Favourably, the horizontal length of the female coupling recess is less than the total vertical thickness of the first floor panel.

In one embodiment, the upper guiding surface is essentially vertical and extends directly above the vertical locking means of the female coupling recess.

In an alternative embodiment, the upper guiding surface is inclined leaning towards a said remaining, main portion of the first floor panel and extends directly above the vertical locking means of the female coupling recess.

In one embodiment, the lower guiding surface is curved. In another alternative embodiment, the lower guiding surface is inclined.

In a favourable embodiment of the invention, the vertical locking means of the male coupling tongue is located at a distance from a distal main vertical joint surface on the second floor panel in a direction towards a remaining, main portion of said second floor panel in order to avoid chafing contact between said vertical locking means and the top floor surface of the adjoining first floor panel upon insertion of the male coupling tongue into the female coupling recess.

In one embodiment, the width of the upwardly extending locking lip exceeds the mean width of the male coupling tongue.

Favourably, the vertical height of the vertical locking means measured from a bottom plane of the floor panels exceeds the corresponding height of the upwardly extending locking lip by at least 30%.

Further advantages and advantageous features of the invention are disclosed in the following description and in the appended claims.

BRIEF DESCRIPTION OF THE DRAWINGS

With reference to the appended drawings, below follows a more detailed description of embodiments of the invention cited as examples.

DETAILED DESCRIPTION OF EXAMPLE EMBODIMENTS OF THE INVENTION

Figure 1:
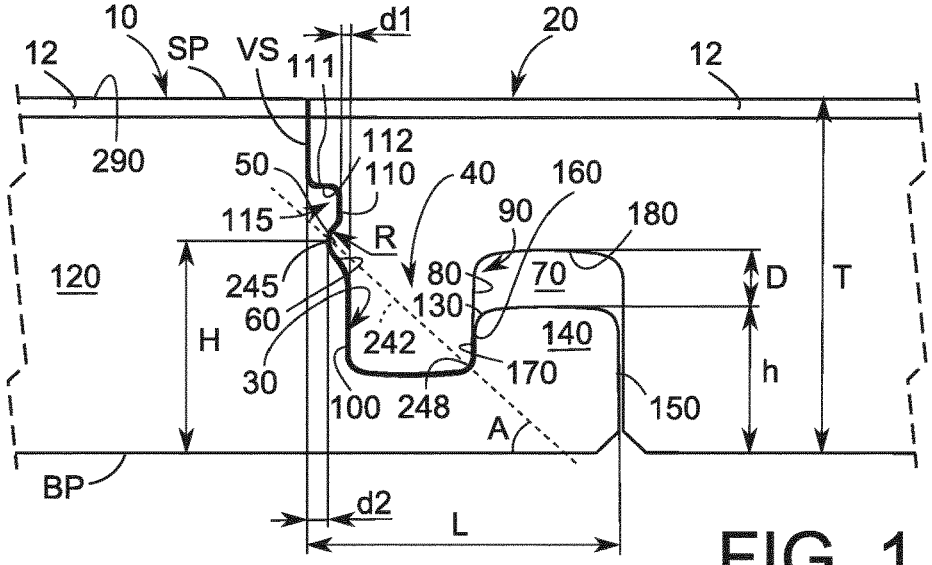
FIG. 1 shows a side view of a joining system according to the present invention, as applied on exemplifying floor panels. The joining system is shown in a joined, fully engaged and vertically locked position.

The invention will now be described with reference to embodiments of the invention and with reference to the appended drawings. With initial reference to FIG. 1, this figure shows a side view of a joining system according to the present invention, as applied on exemplifying floor panels 10, 20. In the shown embodiment, the floor panels 10, 20 are each provided with a decorative top layer 12. The joining system initially is shown in a joined, fully engaged and vertically locked position and includes a female coupling recess 30 formed in a first floor panel 10, said female coupling recess 30 being adapted to receive a male coupling tongue 40 projecting from an adjoining second floor panel 20 in a direction perpendicular to a main floor surface plane SP in which the floor panels 10, 20 are laid, said male coupling tongue 40 being provided with vertical locking means 50 enabling a vertical snap joint interlocking engagement with a matching vertical locking means 60 in said female coupling recess 30. The joining system further includes an elasticity slot 70 for facilitating resilient movement in said vertical snap joint interlocking engagement, the male coupling tongue 40 being configured to be essentially resilient whereas the female coupling recess 30 is configured to be essentially rigid and non-resilient.

The elasticity slot 70 is located in the second floor panel 20, the male coupling tongue 40 forming a side wall surface 80 of the elasticity slot 70 on the opposite side 90 of the male coupling tongue 40 with respect to the side 100 with said vertical locking means 50, enabling enhanced resilience upon insertion of the male coupling tongue 40 into the female coupling recess 30.

An upper guiding surface 110 is located on a side 115 of the female coupling recess 30 on the first panel 10, forming an essentially non-resilient vertical guide for the male coupling tongue 40 upon insertion thereof, limiting movement of said male coupling tongue 40 in a horizontal direction towards a remaining, main portion 120 of the first floor panel 10. A horizontal load bearing abutment surface 111 is located directly above the upper guiding surface 111 in the female coupling recess 30. This horizontal load bearing abutment surface 111 is adapted to function as an abutment for a matching, downwardly facing horizontal upper lip surface 112 on the second floor panel 20, contributing to the overall stability and load bearing capability of the joining system.

A lower guiding surface 130 is located on an upwardly extending horizontal locking lip 140 formed at a distal end 150 of the female coupling recess 30 with respect to the remaining, main portion 120 of the first floor panel 10. The lower guiding surface 130 forces the male coupling tongue 40 to resiliently deflect whilst in engagement with said upper guiding surface 110 upon further vertical insertion thereof in a curved J-shaped deflection movement towards said remaining, main portion 120 of the first floor panel 10, until the vertical locking means 50 of the male coupling tongue 40 snaps together with the matching vertical locking means 60 of the female coupling recess 30. The lower guiding surface 130 transitions—at its lowest end 160 transitions into an essentially vertically extending horizontal locking surface 170 exerting a horizontal pressure—schematically illustrated with P-marked arrows in the FIG. 4—on the male coupling tongue 40 in a horizontal direction towards a remaining, main portion 120 of the first floor panel 10, holding the vertical locking means 50, 60 in engagement with each other in a fitted state between the first floor panel 10 and the second floor panel 20.

In the embodiment shown in FIG. 1, the vertical locking means 50 on the male coupling tongue 40 is constituted by a continuously curved bulb-shaped protrusion 240 which extends from the male coupling tongue 40 and that the vertical locking means 60 in the female coupling recess 30 is constituted by a matching concave locking groove 250. Furthermore, in the shown embodiment, the joining system includes a single set of mutually matching vertical locking means 50, 60 located on the male coupling tongue 40 and in the female coupling recess 30, respectively.

As seen in the figure, the bulb-shaped protrusion 240 has a radius R and a diagonal line 242 intersecting an apex point 245 and a lower edge point 248 of the male coupling tongue 40 is angled with an angle A between 40 and 50 degrees.

The horizontal length L of the female coupling recess 30 is less than the total vertical thickness T of the first floor panel 10. Furthermore, the vertical height H of the vertical locking means 50, 60 measured from a bottom plane BP of the floor panels 10, 20 exceeds the corresponding height h of the upwardly extending locking lip 140 by at least 30%. In alternative, not shown embodiments said percentage may for example be 40%, 50% or 60%. The vertical distance D between an upper limitation wall 180 of the elasticity slot 130 and the upwardly extending horizontal locking lip 140 may be varied to achieve a desired resilience of the male coupling tongue 40 for various material properties in the floor panels 10, 20. In this embodiment, at least a part of an upper limitation wall 180 of the elasticity slot 70 is essentially horizontally aligned with the vertical locking means 50 of the male coupling tongue 40.

The upper guiding surface 110 is essentially vertical and extends directly above the vertical locking means 60 of the female coupling recess 30. Furthermore, in the shown embodiment, the lower guiding surface 130 is curved in order to obtain a smooth and durable guiding action.

Figure 2:
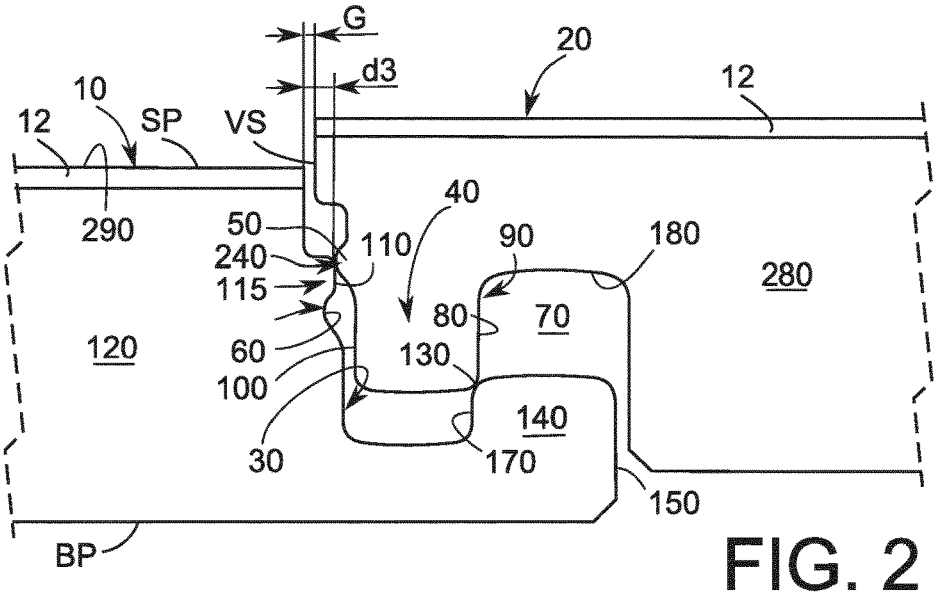
FIG. 2 shows a similar side as in FIG. 1, albeit with the joining system in a first insertion position.

FIG. 2 shows a similar side as in FIG. 1, albeit with the joining system in a first insertion position. As illustrated in the figure, the vertical locking means 50 of the male coupling tongue 40 is located at a distance d3 from a distal main vertical joint surface VS on the second floor panel 20 in a direction towards a remaining, main portion 280 of said second floor panel 20. This is in order to in order to avoid chafing contact between said vertical locking means 50 and a top floor surface 290 of the adjoining first floor panel 10 upon insertion of the male coupling tongue 40 into the female coupling recess 30.

Figure 3:
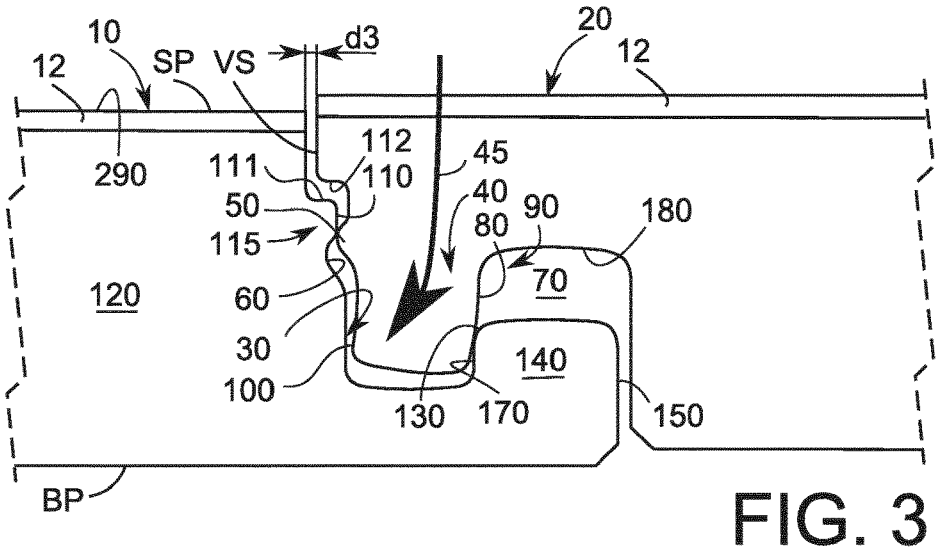
FIG. 3 shows a further side view of the joining system in an intermediate insertion position, wherein the male coupling tongue is resiliently curved to the left in the figure, immediately before finally snapping into the final locked position as shown in FIGS. 1 and 4.
Figure 4:
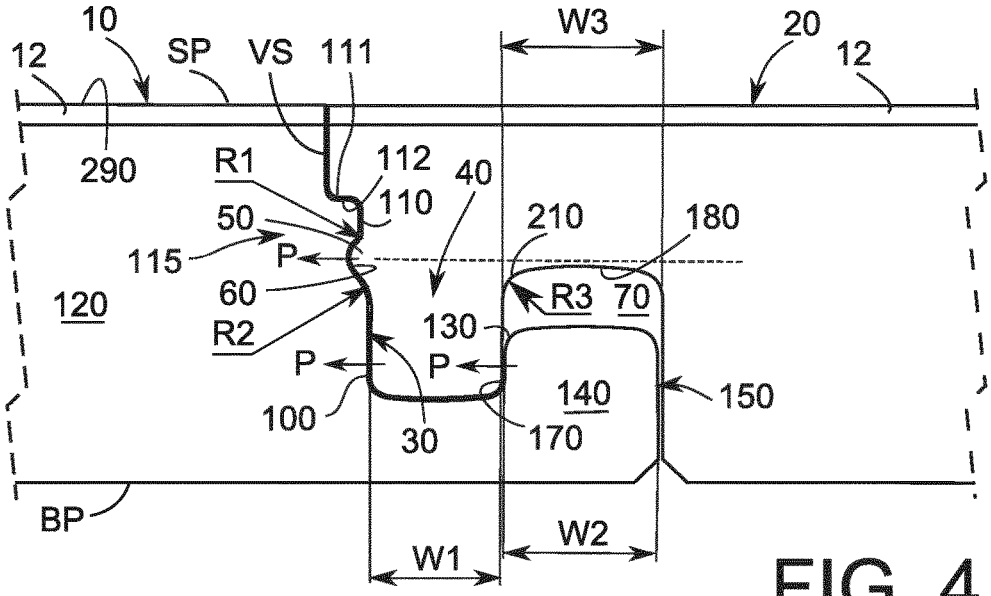
FIG. 4 shows a final side view of the joining system shown in a joined, fully engaged and vertically locked position. Although this side view shows the joining system in the same position as in FIG. 1, this figure illustrates some additional dimensional features of the system.

FIG. 3 shows a further side view of the joining system in an intermediate insertion position, wherein the male coupling tongue 40 is resiliently curved to the left in the figure, immediately before finally snapping into the final locked position as shown in FIGS. 1 and 4 the curved J-shaped deflection as mentioned initially, is illustrated by the curved arrow 45.

FIG. 4 shows a final side view of the joining system shown in a joined, fully engaged and vertically locked position. Although this side view shows the joining system in the same position as in FIG. 1, this figure illustrates some additional dimensional features of the system. For example, the width W2 of the upwardly extending locking lip 140 exceeds the mean width W1 of the male coupling tongue 40. Furthermore, the width W3 of the elasticity slot 70 corresponds essentially to the width W3 of the upwardly extending horizontal locking lip 140 formed at a distal end 150 of the female coupling recess 30. An upper limitation wall 180 of the elasticity slot 70 transitions into an essentially vertical side wall surface 80 of the male coupling tongue 40 via a curved transition portion 210 thereof, with a radius R3. Also, the figure shows that the bulb-shaped protrusion 240 transitions into the male coupling tongue 40 via an upper transition radius R1 and a lower transition radius R2, the lower transition radius R2 being greater than the upper transition radius R1.

Figure 5:
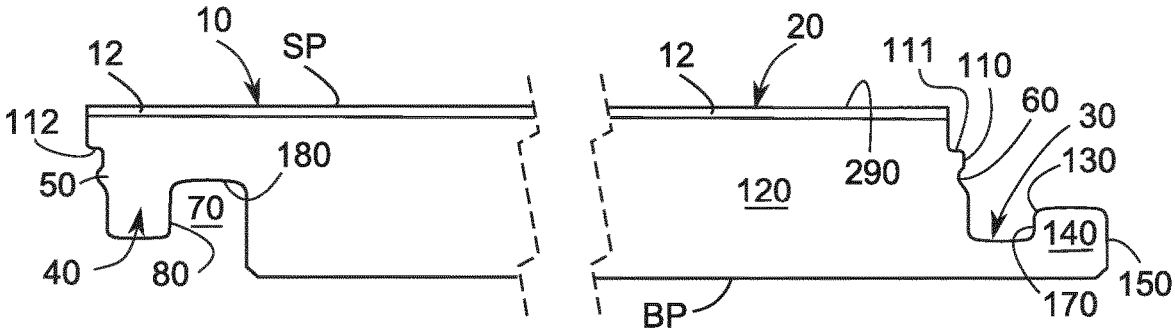
FIG. 5 shows a broken side view of a typical floor panel according to the invention, being provided with a male coupling tongue on one short side and a female coupling recess on the other side.

FIG. 5 shows a broken side view of a typical floor panel 10, 20 according to the invention, being provided with a male coupling tongue 40 on one short side and a female coupling recess 40 on the other short side.

Figure 6:
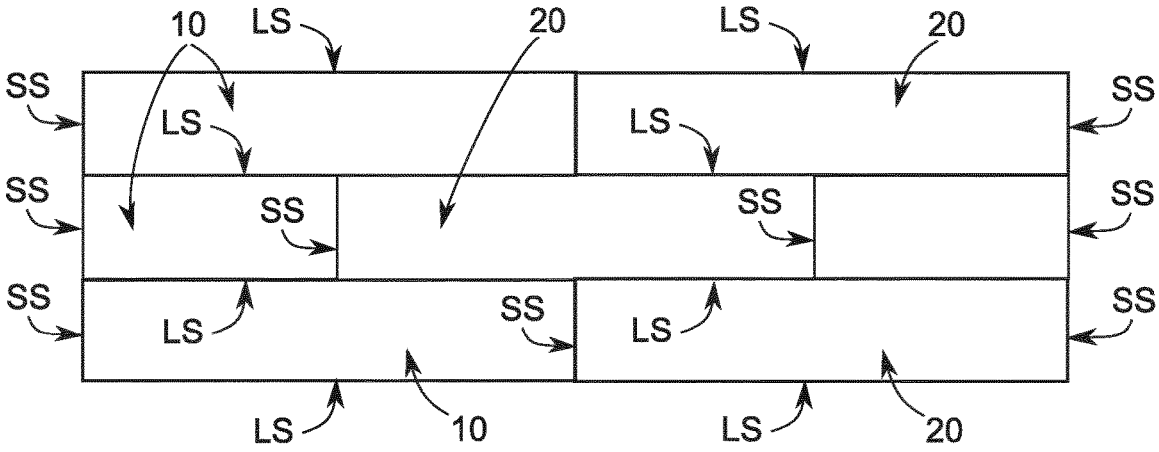
FIG. 6 shows schematic top view of several adjoining floor panels provided with angle-in joints on the long sides thereof and fold-down joints on the short sides thereof.

FIG. 6 shows schematic top view of several adjoining floor panels 10, 20 provided with angle-in joints on the long sides LS thereof and fold-down joints on the short sides SS thereof.

Figure 7:
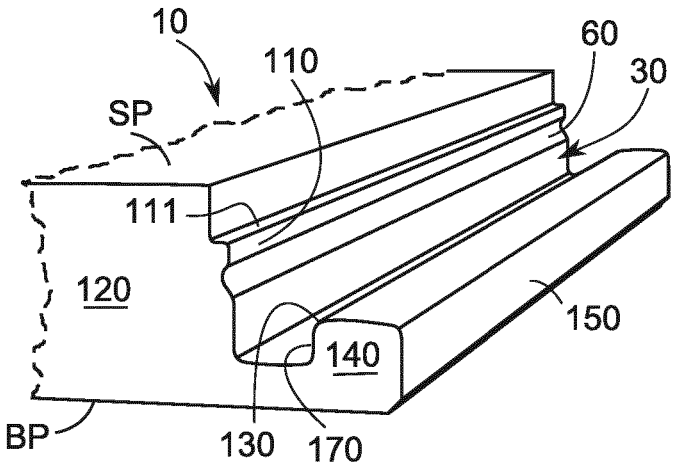
FIG. 7 shows a broken perspective view of a first floor panel with a female coupling recess according to the invention.
Figure 8:
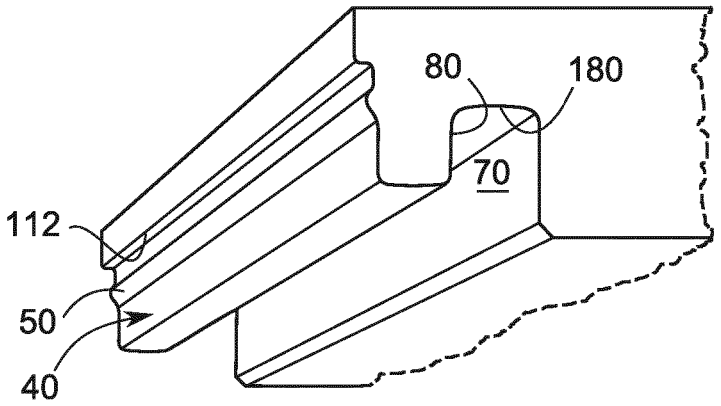
FIG. 8 shows a broken perspective view of a second floor panel with a male coupling tongue according to the invention.

FIG. 7 shows a broken perspective view of a first floor panel 10 with a female coupling recess 30 according to the invention. Likewise, FIG. 8 shows a broken perspective view of a second floor panel 20 with a male coupling tongue 40 according to the invention.

Figure 9:
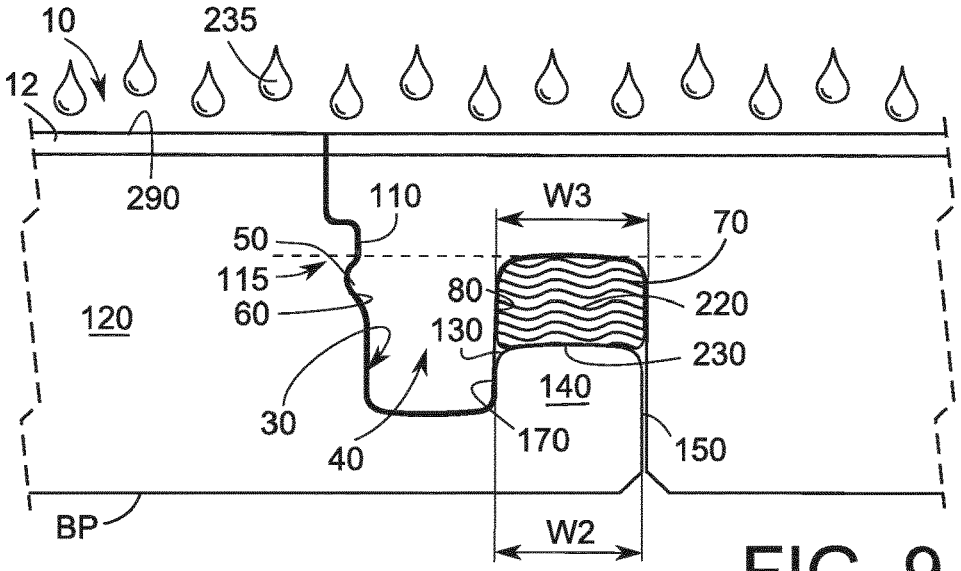
FIG. 9 shows a side view of an alternative embodiment of a joining system according to the invention provided with a resilient waterproofing sealing compound or sealing trim mounted within the elasticity slot. The elasticity slot in this embodiment is deeper than the slots shown in FIGS. 1-8.

FIG. 9 shows a side view of an alternative embodiment of a joining system according to the invention provided with a resilient waterproofing seal 220 which is positioned in the elasticity slot 70. The waterproofing seal 220 is configured to seal between the elasticity slot 70 and an upper sealing surface 230 of the upwardly extending horizontal locking lip 140 formed at a distal end 150 of the female coupling recess 30. The elasticity slot 70 in this embodiment is deeper than the slots shown in FIGS. 1-8. Water droplets 235 indicate water spillage on the decorative top layer 12.

Figure 10:
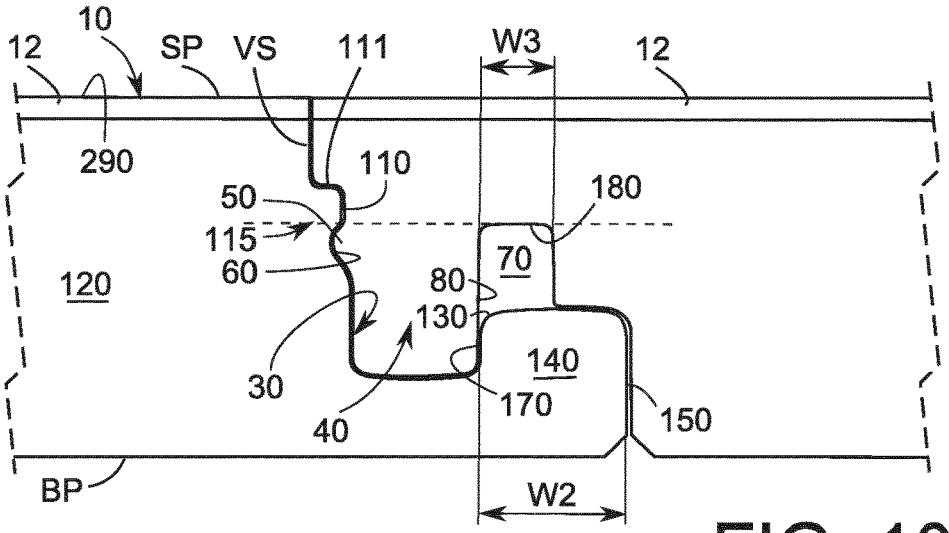
FIG. 10 shows a side view of another alternative embodiment of a joining system according to the invention, wherein the elasticity slot is narrower than the previously illustrated slots.

FIG. 10 shows a side view of another alternative embodiment of a joining system according to the invention, wherein the elasticity slot 70 is narrower than the previously illustrated slots. More particularly, the width W3 of the elasticity slot 70 is essentially half of the width W2 of the upwardly extending horizontal locking lip 140 formed at a distal end 150 of the female coupling recess 30.

Figure 11:
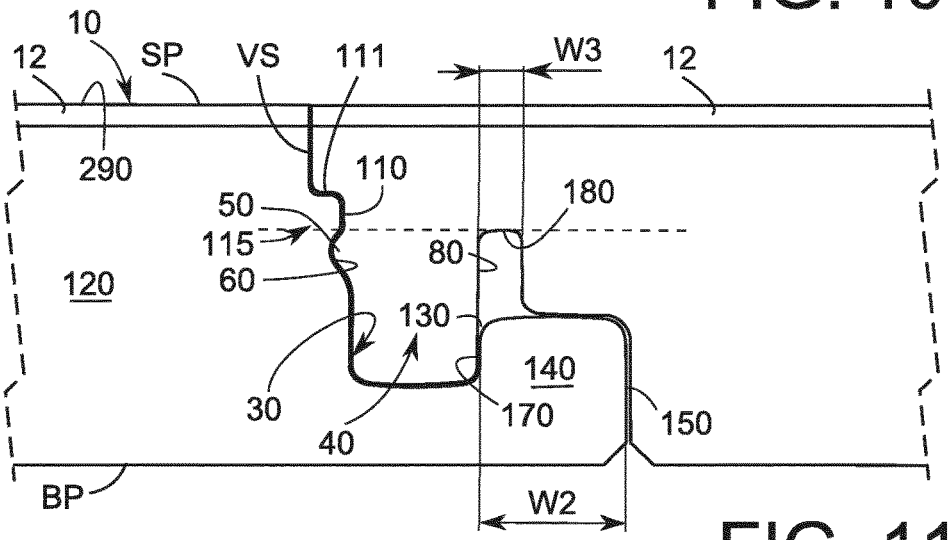
FIG. 11 shows a side view of yet another alternative embodiment of a joining system according to the invention, wherein the elasticity slot is narrower than the slot shown in FIG. 10.

FIG. 11 shows a side view of yet another alternative embodiment of a joining system according to the invention, wherein the elasticity slot is narrower than the slot shown in FIG. 10. More particularly, the width W3 of the elasticity slot 70 is essentially a third of the width W2 of the upwardly extending horizontal locking lip 140 formed at a distal end 150 of the female coupling recess 160.

Figure 12:
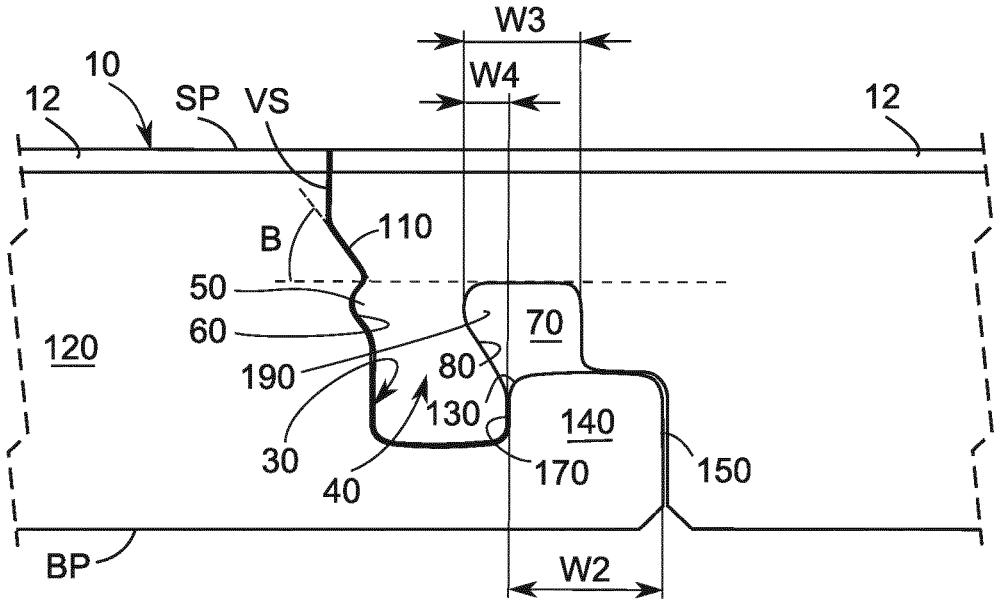
FIG. 12 shows a side view of yet an alternative embodiment of a joining system according to the invention, wherein the elasticity slot partially extends into the side of the male coupling tongue.

FIG. 12 shows a side view of yet an alternative embodiment of a joining system according to the invention, wherein the elasticity slot 70 partially extends into the side of the male coupling tongue 40. As seen in the figure, the elasticity slot 70 is at least partially inclined so as to form a partial undercut 190 into the side wall 200 of the male coupling tongue 40. The width W3 of the elasticity slot 70 and the width W4 of the undercut 190 is indicated in the figure.

Figure 13:
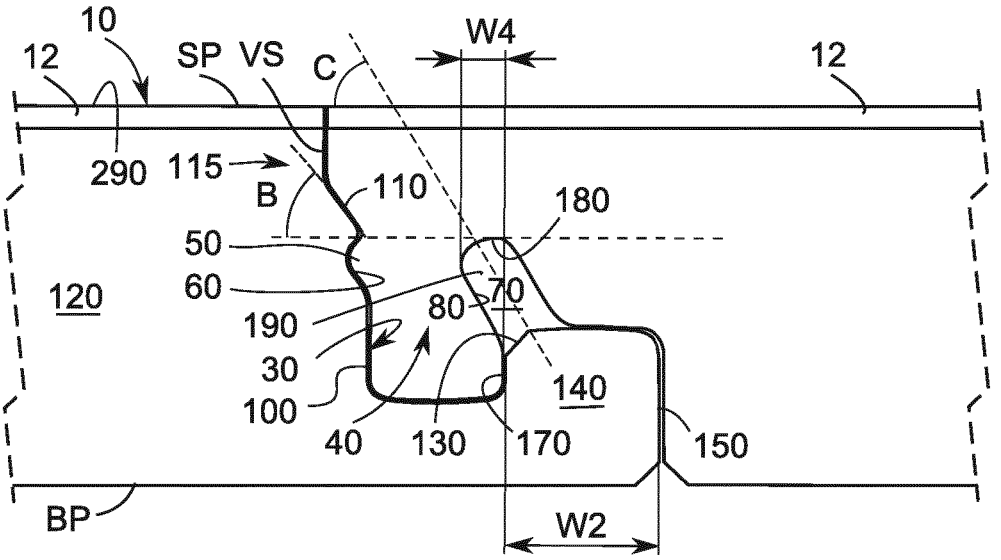
FIG. 13 shows a side view of a further alternative embodiment of a joining system according to the invention, wherein the elasticity slot is inclined and extends into the side of the male coupling tongue.

FIG. 13 shows a side view of a further alternative embodiment of a joining system according to the invention, wherein the elasticity slot 70 is inclined by an angle C and extends into the side of the male coupling tongue 40. Like in the embodiment previously shown in FIG. 12 the elasticity slot 70 is at least partially inclined so as to form a partial undercut 190 into the side wall surface 80 of the male coupling tongue 40. The width W4 of the undercut 190 is indicated in the figure. In this embodiment the lower guiding surface 130 is inclined as opposed to the curved lower guiding surfaces 130 shown in the other embodiments.

In both embodiments shown in FIGS. 12 and 13, the upper guiding surface 110 is inclined with an angle B, leaning towards said remaining, main portion 120 of the first floor panel 10 and extends directly above the vertical locking means 60 of the female coupling recess 30.

Figure 14:
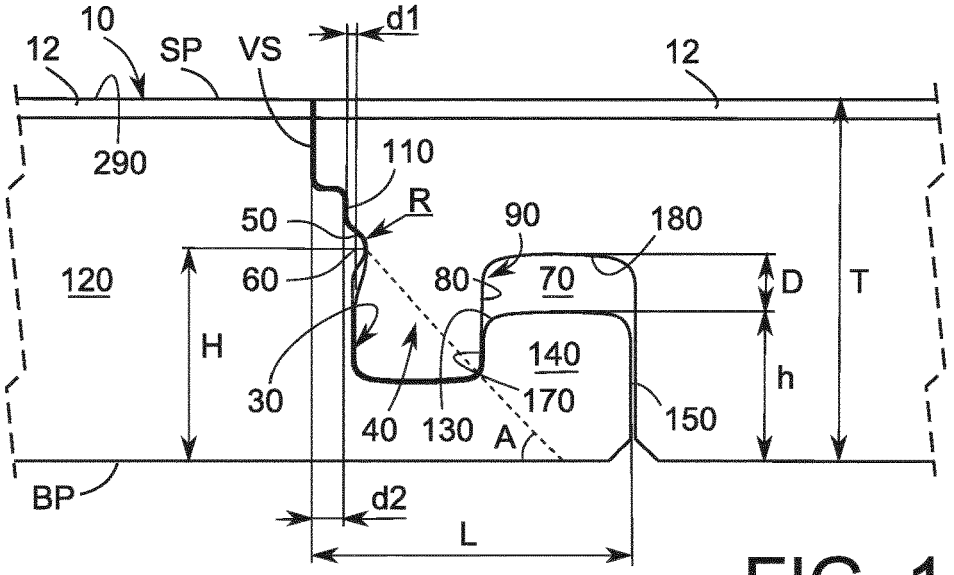
FIG. 14 shows a side view of an alternative embodiment of a joining system according to the invention, wherein the vertical locking means are inverted when compared to the embodiments shown in the previous figures. The joining system is shown in a joined, fully engaged and vertically locked position.
Figure 15:
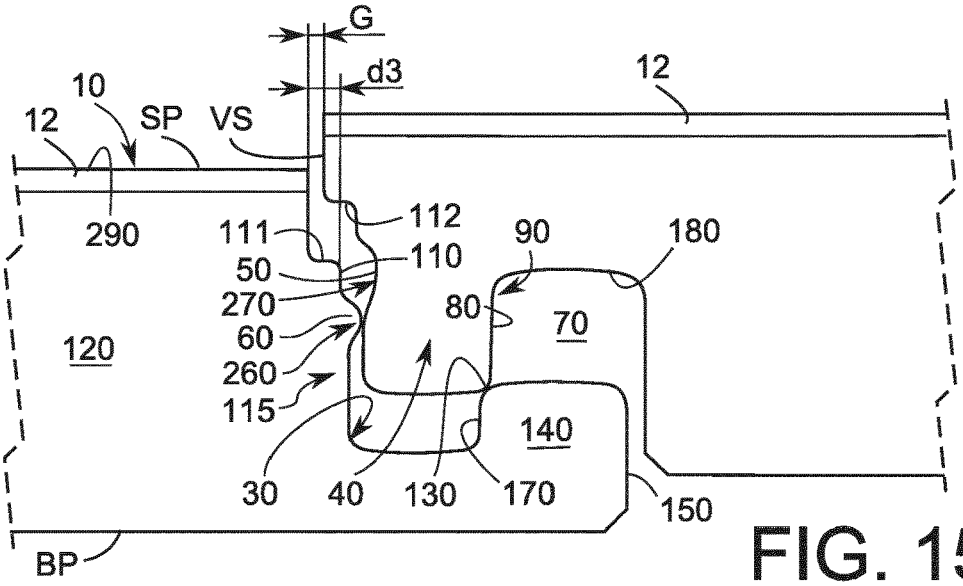
FIG. 15 shows the same embodiment as in FIG. 14, but with the joining system in a first insertion position.
Figure 16:
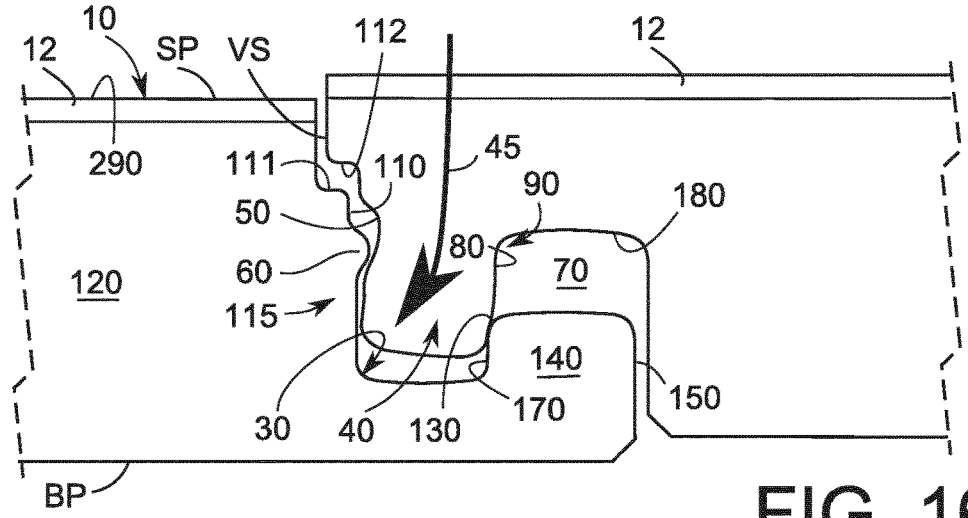
FIG. 16 finally shows the embodiment introduced with FIGS. 14 and 15, with the joining system in an intermediate insertion position, wherein the male coupling tongue is resiliently curved to the left in the figure, immediately before finally snapping into the final locked position as shown in FIG. 14.

FIG. 14, FIG. 15 and FIG. 16 shows a side views of an alternative embodiment of a joining system according to the invention, wherein the vertical locking means are inverted when compared to the embodiments shown in the previous figures. In this embodiment the vertical locking means 60 in said female coupling recess 30 is constituted by a continuously curved bulb-shaped protrusion 260 extending from the female coupling recess 30 and that the vertical locking means 50 on the male coupling tongue 40 is constituted by a matching concave locking groove 270. Apart from this reverse configuration, the dimensional properties as illustrated by the measurement indications are the same as described earlier with respect to the embodiments above. Hence, In FIG. 14, the joining system is shown in a joined, fully engaged and vertically locked position. FIG. 15 shows the same embodiment as in FIG. 14, but with the joining system in a first insertion position. Finally, FIG. 16 shows the embodiment introduced with FIGS. 14 and 15, with the joining system in an intermediate insertion position, wherein the male coupling tongue 40 is resiliently curved to the left in the figure as illustrated by arrow 45.

The joining system according to the invention is equally applicable to a wide variety of materials, such as for example solid wood, laminated wood, different types of fibreboard materials like MDF or HDF materials, plastic or composite polymer materials like PVC, or other polymer materials and metals such as aluminium. The joining system may also be used for joining hollow profile beams in plastic, steel or aluminium.

It is to be understood that the present invention is not limited to the embodiments described above and illustrated in the drawings and a skilled person will recognize that many changes and modifications may be made within the scope of the appended claims.

The invention claimed is:

1. A joining system for floor panels, comprising a female coupling recess formed in a first floor panel, said female coupling recess being adapted to receive a male coupling tongue projecting from an adjoining second floor panel in a direction perpendicular to a main floor surface plane in which the floor panels are laid, said male coupling tongue being provided with vertical locking means enabling a vertical snap joint interlocking engagement with a matching vertical locking means in said female coupling recess, the joining system further including an elasticity slot for facilitating resilient movement in said vertical snap joint interlocking engagement, the male coupling tongue being configured to be essentially resilient whereas the female coupling recess is configured to be essentially rigid and non-resilient, wherein:

the elasticity slot is located in the second floor panel, the male coupling tongue forming a side wall surface of the elasticity slot on the opposite side of the male coupling tongue with respect to the side with said vertical locking means, enabling enhanced resilience upon insertion of the male coupling tongue into the female coupling recess;

an upper guiding surface is located on a side of the female coupling recess on the first panel, forming an essentially non-resilient vertical guide for the male coupling tongue upon insertion thereof, limiting movement of said male coupling tongue in a horizontal direction towards a remaining, main portion of the first floor panel;

a lower guiding surface is located on an upwardly extending horizontal locking lip formed at a distal end of the female coupling recess with respect to the remaining, main portion of the first floor panel, said lower guiding surface forcing the male coupling tongue to resiliently deflect whilst in engagement with said upper guiding surface upon further vertical insertion thereof in a curved J-shaped deflection movement towards said remaining, main portion of the first floor panel, until the vertical locking means of the male coupling tongue snaps together with the matching vertical locking means of the female coupling recess;

the uppermost horizontal width of the upwardly extending horizontal locking lip exceeds an uppermost width of the male coupling tongue when the joining system is joined, and said lower guiding surface at its lowest end transitions into an essentially vertically extending horizontal locking surface exerting a horizontal pressure on the male coupling tongue in a horizontal direction towards a remaining, main portion of the first floor panel, holding the vertical locking means in engagement with each other in a fitted state between the first floor panel and the second floor panel.

2. The joining system for floor panels according to claim 1, wherein at least a part of an upper limitation wall of the elasticity slot is essentially horizontally aligned with the vertical locking means of the male coupling tongue.

3. The joining system for floor panels according to claim 1, wherein the width of the elasticity slot essentially corresponds to the width of the upwardly extending horizontal locking lip formed at a distal end of the female coupling recess.

4. The joining system for floor panels according to claim 1, wherein the width of the elasticity slot is essentially half of the width of the upwardly extending horizontal locking lip formed at a distal end of the female coupling recess.

5. The joining system for floor panels according to claim 1, wherein the width of the elasticity slot is essentially a third of the width of the upwardly extending horizontal locking lip formed at a distal end of the female coupling recess.

6. The joining system for floor panels according to claim 1, wherein the elasticity slot is at least partially inclined so as to form a partial undercut into the side wall surface of the male coupling tongue.

7. The joining system for floor panels according to claim 1, wherein an upper limitation wall of the elasticity slot transitions into an essentially vertical side wall surface of the male coupling tongue via a curved transition portion thereof.

8. The joining system for floor panels according to claim 1, wherein a resilient waterproofing seal is positioned in the elasticity slot, said waterproofing seal being configured to seal between the elasticity slot and an upper sealing surface of the of the upwardly extending horizontal locking lip formed at a distal end of the female coupling recess.

9. The joining system for floor panels according to claim 1, wherein the vertical locking means on the male coupling tongue is constituted by a continuously curved bulb-shaped protrusion extending from the male coupling tongue and wherein the vertical locking means in the female coupling recess is constituted by a matching concave locking groove.

10. The joining system for floor panels according to claim 1, wherein the vertical locking means in said female coupling recess is constituted by a continuously curved bulb-shaped protrusion extending from the female coupling recess and wherein the vertical locking means on the male coupling tongue is constituted by a matching concave locking groove.

11. The joining system for floor panels according to claim 1, wherein the joining system includes a single set of mutually matching vertical locking means located on the male coupling tongue and in the female coupling recess, respectively.

12. The joining system for floor panels according to claim 1, wherein the horizontal length of the female coupling recess is less than the total vertical thickness of the first floor panel.

13. The joining system for floor panels according to claim 1, wherein the upper guiding surface is essentially vertical and extends directly above the vertical locking means of the female coupling recess.

14. The joining system for floor panels according to claim 1, wherein the upper guiding surface is inclined leaning towards a said remaining, main portion of the first floor panel and extends directly above the vertical locking means of the female coupling recess.

15. The joining system for floor panels according to claim 1, wherein the lower guiding surface is curved.

16. The joining system for floor panels according to claim 1, wherein the lower guiding surface is inclined.

17. The joining system for floor panels according to claim 1, wherein the vertical locking means of the male coupling tongue is located at a distance from a distal main vertical joint surface on the second floor panel in a direction towards a remaining, main portion of said second floor panel in order to avoid chafing contact between said vertical locking means and a top floor surface of the adjoining first floor panel upon insertion of the male coupling tongue into the female coupling recess.

18. The joining system for floor panels according to claim 1, wherein the vertical height of the vertical locking means measured from a bottom plane of the floor panels exceeds the corresponding height of the upwardly extending locking lip by at least 30%.

* * * * *